United States Patent [19]

Finnemore

[11] Patent Number: 4,593,750

[45] Date of Patent: Jun. 10, 1986

[54] RADIAL SEAL ASSEMBLY FOR ROTARY REGENERATIVE HEAT EXCHANGER

[75] Inventor: Harlan E. Finnemore, Wellsville, N.Y.

[73] Assignee: The Air Preheater Company, Inc., Wellsville, N.Y.

[21] Appl. No.: 767,010

[22] Filed: Aug. 19, 1985

[51] Int. Cl.[4] ..... F28D 19/00

[52] U.S. Cl. ..... 165/9; 165/5

[58] Field of Search ..... 165/9

[56] References Cited

U.S. PATENT DOCUMENTS

| | | | |
|---|---|---|---|
| 2,874,939 | 2/1959 | Rahr et al. | 165/9 |
| 3,311,162 | 3/1967 | Chapman et al. | 165/9 |
| 3,954,135 | 5/1976 | Hewlitt | 165/9 |
| 4,071,076 | 1/1978 | Sakaki | 165/9 |
| 4,098,323 | 7/1978 | Wiegard et al. | 165/9 |

*Primary Examiner*—Albert W. Davis, Jr.
*Attorney, Agent, or Firm*—William W. Habelt

[57] ABSTRACT

A rotary regenerative heat exchanger 10 having a rotor 12 mounted to a central rotor post 18 for rotation within a surrounding housing 20 whereby heat absorbent material carried in the rotor is alternately exposed to a flow of heating gas and a gas to be heated. A radial seal assembly 50 including a flexible sealing strip 72 is mounted to the hot end edge of each radially extending partition 16 of the rotor 12 to establish a seal across the gap between the radially extending partitions 16 and the confronting face of the sector plate 24 of the housing 20 as the rotor is rotated. Each radial seal assembly 50 is provided with a back support leaf 64 having an outward portion 68 which provides a backstop to limit the backward bending of the flexible sealing strip 72 so as to preclude stressing of the sealing strip beyond its yield point.

4 Claims, 4 Drawing Figures

RADIAL SEAL ASSEMBLY FOR ROTARY REGENERATIVE HEAT EXCHANGER

BACKGROUND OF THE INVENTION

The present invention relates generally to rotary heat exchangers and, more specifically, to an improved radial sealing assembly for use between relatively rotatable parts of a rotary regenerative heat exchanger.

In a typical rotary regenerative heat exchanger, such as a rotary air preheater, a cylindrical rotor is disposed about a central rotor post and divided into a plurality of sector-shaped compartments by a plurality of radial partitions extending from the rotor post to the outer shell of the rotor. A mass of heat absorbent material commonly comprised of packed plate-like elements is carried in each of the sector-shaped compartments of the rotor. As the rotor is rotated about the central axis of the rotor post, heat absorbent material is alternately exposed to a stream of a heating gas and then upon further rotation of the rotor to a stream of cooler air or other gas to be heated. As the heat absorbent material is exposed to the heating gas, it absorbs heat therefrom and when exposed to the cool air or other gas to be heated, the heat absorbed from the heating gas by the heat absorbent material is transferred to the cooler air or gas. The rotor is surrounded by a housing including end plates at opposite ends thereof having flow impervious portions located between circumferentially spaced openings that provide for the flow of the heating gas and the gas to be heated through the rotor. To prevent mingling of the heating gas with the air or other gas to be heated, the radial partitions that form the rotor compartments are provided with radial sealing members along their edges to wipe against the flow impervious portions of the end plates as the rotor rotates thereby providing a sealing relationship.

In a typical rotary regenerative heat exchanger, such as an air preheater, the heating gas, hereinafter referred to as the hot gas, and the gas to be heated, hereinafter referred to as cold air, enter the rotor shell from opposite ends and pass in opposite directions over the heat exchange material housed within the rotor. Thus, the cold air inlet and the cooled gas outlet are at one end of the heat exchanger housing, commonly referred to as the cold end, while the hot gas inlet and the heated air outlet are at the opposite ends of the heat exchanger housing, commonly referred to as the hot end. As a result of this inlet and outlet configuration, an axial temperature variation exists within the rotor shell from the hot end of the rotor to the cold end of the rotor. In response to this thermal gradient, the rotor tends to distort. As a result, the radial seals mounted on the radial partitions at the hot end of the rotor are pulled away from the end plates of the housing adjacent thereto with the greater separation occurring at the outboard end of the rotor. This opens a gap which if not closed would allow flow therethrough resulting in an undesired intermingling of the gas and the air.

In the typical prior art air preheater, the radial seals were formed of rigid leaves extending along the end edge of the radial partitions so as to bridge the gap between the end surface of the radial partition and the confronting face of the end plates of the housing. As this rigid sealing leaf would pull away from the end plate at the hot end of the rotor as described hereinbefore, various schemes were developed for reestablishing contact between the seal leaves mounted to the radial partitions and the end plates. For example, in U.S. Pat. Nos. 3,786,868, 4,124,063 and 4,206,803, the end plate at the hot end physcially distorts to recontact the radial seals mounted to the radial partitions. In U.S. Pat. Nos. 3,095,036, 3,166,119, and 3,189,084, the seal leaves themselves are slidably mounted to the radial partitions so as to be physically movable back into contact with the end plates despite the turn down of the rotor. However, in either arrangement, monitoring and control systems must be provided to ensure that the recontacting of the radial seals with the end plates of the housing takes place in such a manner as not to crush the radial seals.

One proposed solution to this problem is to provide a flexible sealing member between the radial partition and the end plate of the rotor housing. This has been done by mounting flexible metallic strips to the radially outward end of the rigid leaves so that the flexible strips extend outwardly from the rigid leaf to contact the end plate of the rotor housing. The rigid leaf is in turn attached to the radial plate in a conventional manner. The flexible metallic strips will maintain their rigidity under the small pressure differential, typically less than 5 p.s.i., existing between the air and gas streams flowing through the rotor but will flex when the end plates and sealing strips are brought into contact when adjusting for rotor distortion, thereby avoiding damage to the seal leaves while allowing a sealing relationship to be established between the radial partitions and the end plates of the rotor housing.

However, it has been experienced that these relatively thin flexible metallic sealing strips are frequently damaged and ripped off during the soot blowing of the heat transfer element to remove particulates therefrom. It is customary, and periodically necessary, to clean the heat transfer material within the rotor by delivering a blast of high pressure air or steam, typically at about 200 p.s.i., from soot blowers through the passages in the heat transfer material to dislodge any particulate deposits from the surface thereof and carry them away leaving a relatively clean surface and open flow passages in order to maintain the efficiency of the air heater. Unfortunately, the force of the high pressure blowing medium on the relatively thin, flexible sealing strips causes the sealing strips to bend backward frequently resulting in stresses within the sealing strips beyond the yield point of the material from which the flexible sealing strips are formed thereby causing a permanent deformation of the sealing strips which reduce their sealing effectiveness and, after repeated soot blowings, cracking the sealing strips and resulting in a complete loss of the sealing structure..

It is, therefore, an object of the present invention to provide an improved radial sealing assembly wherein flexible sealing strips are provided but the yielding of the sealing strips under the soot blowing pressure is precluded.

SUMMARY OF THE INVENTION

To the fulfillment of this object and other objects which will be evident from the description presented herein, an improved radial seal assembly is provided for mounting along the radial extent of an end edge of each radial rotor partition at at least one end of the rotor so as to bridge the space between the end edge of each radial extending partition at that end of the rotor and the confronting face of the flow impervious end plate of the rotor housing, the radial seal assembly including a rigid forward support leaf, a rigid back support leaf, and at least one flexible sealing strip made of flow impervious resilient material disposed therebetween. The rigid forward support leaf has a base portion which lies substantially co-lateral with the radially extending partition and an extended portion extending outwardly beyond the partition. The rigid back support leaf also has a base portion substantially co-lateral with the base portion of the forward support leaf and the radially extending partition and an extended portion also extending outwardly beyond the partition. At least one flexible sealing strip made of flow impervious resilient material is disposed between the forward support leaf and the back support leaf with the base portion of the sealing strip fixedly sandwiched between the base portions of the forward support leaves and the back support leaf. The assembled base portions are fixedly mounted to the radially extending partition along the radial extent of the partition. The flexible sealing strip also has an extended portion disposed between the extended portions of the forward support leaf and the back support leaf with a tip portion which extends therefrom for contacting in sealing relationship the confronting face of the flow impervious end plates of the rotor housing. The extended portion of the back support leaf includes a radially outward portion with extends backwardly away from the forward support leaf so as to establish an open gap therebetween. The radially outward portion of the back support leaf is positioned so as to provide a back stop to limit the backward bending of the flexible sealing strip so as to preclude bending of the flexible sealing strip beyond the yield point of the resilient material from which the sealing strip is constructed. Perferably, the radially outward portion of the back support leaf is arcuate, curving away from the extended portion of the forward support leaf to provide a conforming back stop surface against which the backwardly bent sealing strip will come to rest during soot blowing.

DESCRIPTION OF A PREFERRED EMBODIMENT

Figure 1:
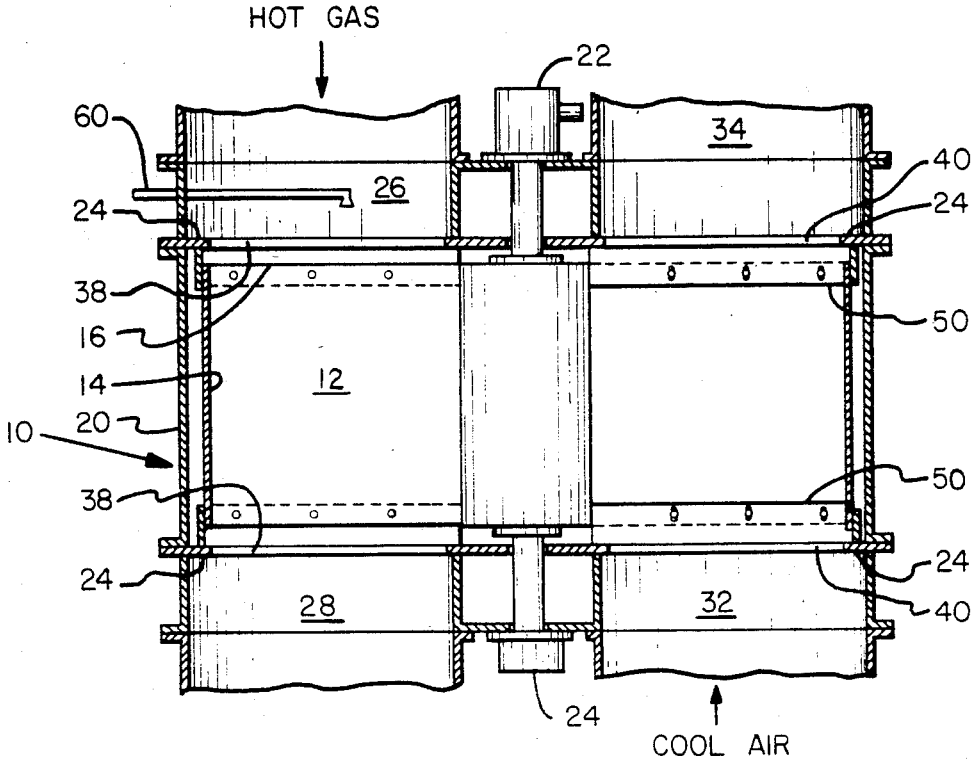
FIG. 1 is a sectional elevational view of a rotary regenerative heat exchanger equipped with the radial seal assembly of the present invention.

Referring now to the drawing, and more particularly to FIG. 1, there is depicted therein a regenerative heat exchange apparatus 10 in which the radial seal assembly of the present invention is utilized. The regenerative heat exchanger 10 comprises a cylindrical housing 20 enclosing a rotor 12 wherein the heat exchange material is carried. The rotor 12 comprises a cylindrical shell 14 interconnected to a central rotor post 18 by a plurality of spaced radially extending partitions 16 which also serve to divide into sector-shaped compartment. The rotor 12 is rotatably mounted on a support bearing 24 in order that it may be rotated as the central rotor post 18 is turned slowly about its axis by the motor and gearing arrangement 22. The rotor 12 is supported for rotation within the cylindrical housing 20 that is provided at its opposite ends with end plates 26, commonly termed sector plates, which are apertured at circumferentially spaced locations to provide openings 38 and 40 to admit and discharge a fluid to be heated, such as cooled air, and a heating fluid, such as hot gas.

The hot gas enters the housing 20 through inlet duct 18 which opens to aperture 38 in the upper sector plate 24 and exits the rotor housing 20 after having passed over the heat absorbent material disposed within the rotor 12 through aperture 38 in the lower sector plate and out the outlet duct 28. Cool air to be heated enters the rotor housing 20 through inlet duct 32 which opens to aperture 40 in the lower sector plate 24 and after passing through the heat absorbent material within the rotor 12 passes through the aperture 40 in the upper sector plate to leave the rotor housing through outlet duct 34. As the rotor 12 rotates, the heat absorbent material carried therein is first moved in contact with the heating gas to absorb heat therefrom and into contact with the cool air to be heated. As the cool air to be heated passes through the heat absorbent material, the cool air absorbs the heat which the heat absorbent material had picked up when in contact with the hot gas.

In order that the streams of gas and air flowing through the rotor 12 do not intermix, it is customary to provide circumferential seals to prevent bypassing of the rotor and also radial seals to prevent the slightly higher pressure cool air from crossing over into the slightly lower pressure hot gas stream. Typically, circumferential seals 30 are provided on the rotor shell 14 to bear against confronting parts of the sector_plate 24 to seal off the clearance space between the rotor shell 10 and the housing 20 at the ends of the rotor 12 to prevent the flow streams from bypassing the rotor 12 by flowing through the annular clearance space. Radial seal means 50 are provided on the end edges of the radial partition 16 to bridge the space between the radial partition 16 and the confronting face of the adjacent end plate 24 to prevent crossover of the flow streams.

Figure 2:
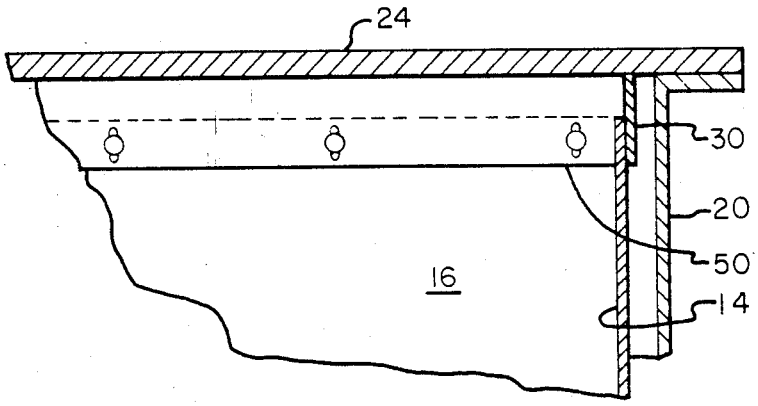
FIG. 2 is an enlarged sectional elevational view showing the radial seal assembly of the present invention.
Figure 3:
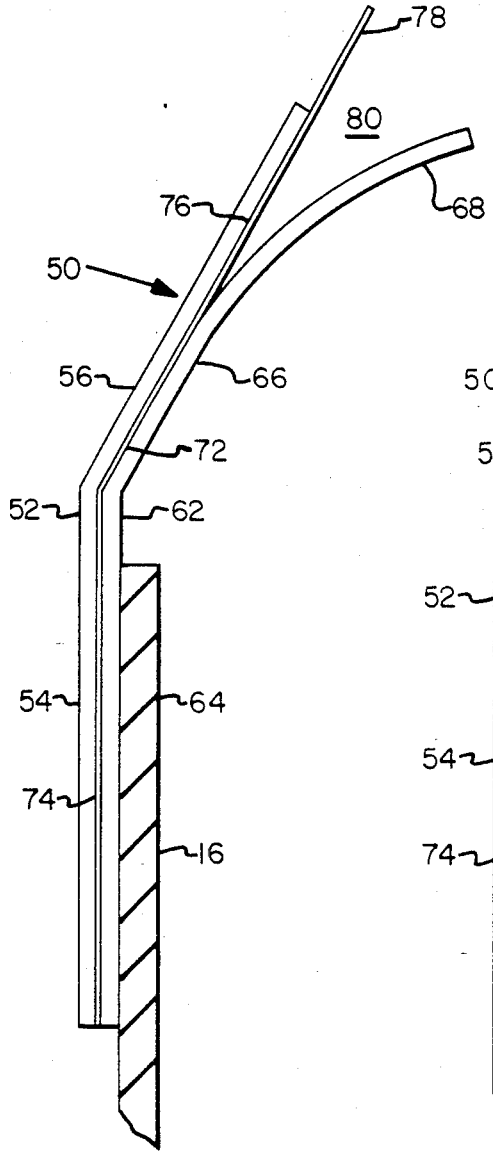
FIG. 3 is an enlarged side elevational view showing the radial seal assembly of the present invention in its forward position.
Figure 4:
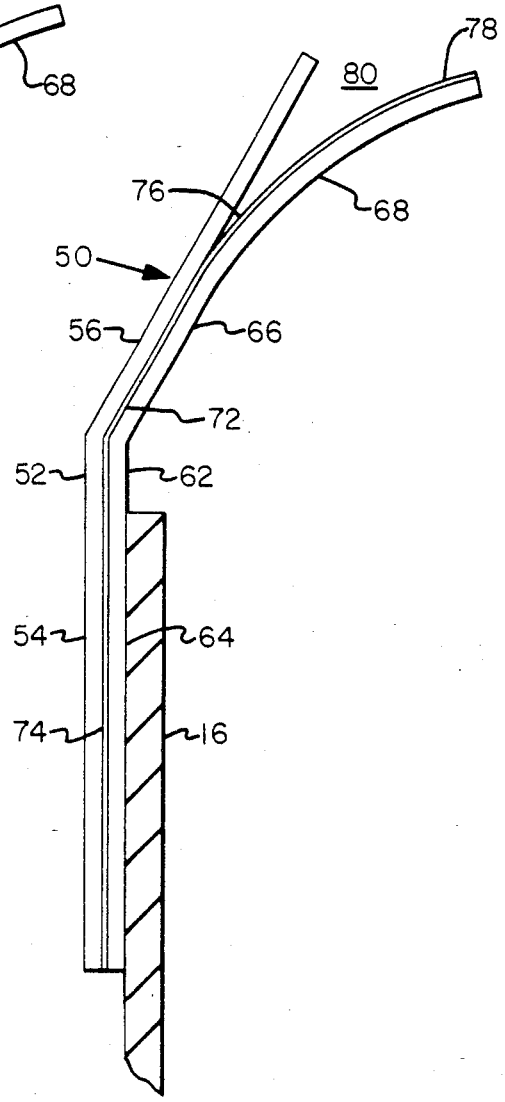
FIG. 4 is an enlarged side elevational view showing the radial seal assembly of the present invention in its backward position.

As best seen in FIGS. 2, 3 and 4, each radial sealing assembly 50 of the present invention comprises a rigid forward support leaf 52 having a base portion 54 and an extended portion 56 extending outwardly from the base portion, a rigid back support leaf 62 having a base portion 64 and a extended portion 66 extending outwardly from the base portion, and at least one flexible sealing strip 72 made of flow impervious resilient material having a base portion 74 and an extended portion 76 extending outwardly from its base portion. The base portion 54 of the forward support leaf 52 and the base portion 64 of the back support leaf 62 are disposed substantially colaterally in closely spaced replationship. The base portion 74 of flexible sealing strip 72 is fixedly sandwiched between the base portions 54 and 64 of the forward support leaf and the back support leaf. The base portions 54, 64 and 74, respectively, of the forward support leaf 52, the back support leaf 62 and the sealing strip 72 may be fixedly mounted together by any of a number of well known means although it is presently contemplated that the preferred method of mounting the three base portions together would be to stamp an indentation through one support leaf and the sealing strip disposed between the support leaves and spot weld the two support leaves together with the sealing strip disposed therebetween. The assembled base portions of the seal assembly may then be fixedly mounted to the partition plate by bolting or welding or any other desired manner.

The extended portion 56 of the forward support leaf extends outwardly from the base portions 54 thereof and is foreshortened such that when the radial seal assembly 50 is mounted to the partition plate 16, the forward support leaf does not make contact with the confronting face of the sector plate 24. Preferably, the extended portion 56 of the forward support leaf 50 extends outwardly from its base 52 at an acute angle preferably of about 30°, to a direct radial extension of the base portion 52 in a direction counter to the direction of rotation of the rotor 12 as illustrated in FIGS. 3 and 4. The extended portion 66 of the rigid back support leaf 62 extends outwardly from its base portion 64 but does not remain co-lateral with the extended portion 56 of the forward support leaf 52 for its entire length, but rather has an outward portion 68 which is directed away from the extended portion 56 of the forward support leaf 52 to provide a gap 80 therebetween. Preferably, the outward portion 68 of the extended portion 66 of the back support leaf 62 is arcuate in form so as to provide a curved surface extending away from the extended portion 56 of the forward support leaf 52. The extended portion 76 of the flexible sealing leaf 72 extends outwardly from its base portion 74 between the extended portions 56 and 66 of the forward support leaf 52 and the back support leaf 62 into the gap 80 therebetween with a tipped portion 78 which extends outwardly beyond the extended portions of the forward support leaf 52 and the backward support leaf 62 as best seen in FIG. 3. The outward portion 68 of the back support leaf 62 serves to limit the backward movement of the tip 78 of the flexible sealing strip 72 so as to preclude stressing of the sealing strip 72 beyond the yield point of the resilient material from which the sealing strip is constructed. As mentioned previously, in order to provide for periodic cleaning of the heat transfer material within the rotor 12, the heat exchanger 10 is provided with nozzle means 60 commonly disposed in the hot gas inlet duct 26 adjacent the aperture 38 so as to direct a high pressure cleaning fluid, typically steamed, water or air, through the heat absorbent material as the rotor rotates slowly and the cleaning nozzles sweeps across the end face of the rotor. As the cleaning fluid is typically at a pressure of about 200 p.s.i., the force of the cleaning fluid causes the tips 78 of the flexible sealing strips 72 to bend backwardly away from the forward support leaf 56. as illustrated in FIG. 4, the outward portion 68 of the back support leaf 62 serves as a back stop to limit the backward bending of the tip 78 under the force of the high pressure cleaning fluid so as to prevent the backward bending or movement of the tip 78 of the sealing strip beyond the yield point of the resilient material from which the sealing strip is made.

In prior art flexible seal assemblies lacking the back stop arrangement of the present invention, the backward movement or bending of the tip 78 would not be so limited. Therefore, the yield stress of the material of which the resilient sealing means 72 is made would frequently be exceeded resulting in a permanent deformation in the sealing strip 72 at its tip end 78 which would decrease the sealing effectiveness of the sealing assembly. Additionally, after repeated extreme bendings of the extended portion 76 of the sealing strip 72, the sealing strip would crack and the tip portion 78 would be torn away from the sealing strip resulting in complete loss of sealing effectivness. In accordance with the present invention, the yielding and subsequent tearing away of the tip portion 78 of the sealing strip 72 is precluded by providing the back stop portion 68 of the back support leaf 66 against which the tip portion 78 of the sealing strip 72 will rest upon when the extended portion 76 of the sealing strip 72 is bent backward under the force of the cleaning fluid. The back stop portion 68 of the back support leaf 66 is directed away from the extended portion 56 of the forward support leaf 52 so as to provide the gap 80 therebetween sufficient in dimension to permit flexing of the extended portion 76 of the sealing strip 72 when the tip portion 78 thereof is in continuous contact with the sector plate 24 of the rotor housing during rotor distortion, but sufficiently limited in dimension to prevent backward bending of the extended portion 76 of the sealing strip to a stress point below that of the yield stress of the material from which the sealing strip is made.

Although a radial seal assembly is shown in the drawing installed on a rotary regenerative heat exchanger having a fixed sector plate arrangement and a fixed radial seal mounting, it is to be understood that the radial seal assembly of the present invention can be readily utilized on rotary regenerative heat exchanger having actuated sector plates, such as shown in U.S. Pat. Nos. 4,124,063 or 4,206,803, or self-compensating unrestrained sector plates such as shown in U.S. Pat. No. 3,786,868, or rotary regenerative heat exchangers having adjustable seal assemblies such as shown in U.S. Pat. Nos. 3,166,119 or 3,189,084 or 3,095,036. Further, it is to be understood that the flexible sealing strip 72 disposed between the forward support leaf and the back support leaf may be comprised of a single sealing strip or any number of multiple sealing strips. The embodiment shown in the drawing wherein a single sealing strip is disposed between the forward support leaf and the back support leaf to form the flexible sealing member is merely for purposes of illustration and not limitation.

In the preferred embodiment illustrated in the drawing, the improved radial sealing assembly 50 of the present invention is installed on the radial partitions at both ends of the rotor. However, it is to be understood that in various installations, a rotary regenerative heat exchanger under the present invention may incorporate the improved radial sealing assembly 50 of the present invention at only one end of the rotor, i.e. either only at the "hot" end of the rotor or only at the "cold" end of the rotor as desired.

I claim:

1. A radial seal assembly for use in a rotary regenerative heat exchanger of the type including a rotor having a cylindrical rotor shell mounted concentrically about and joined to a central rotor post adapted for rotationg about its axis by a plurality of circumferentially spaced radially extending partitions so as to divide the rotor into a plurality of sector-shaped compartments adapted to carry a mass of heat absorbent material, and a cylindrical housing surrounding the rotor provided at opposite ends thereof with end plates having flow impervious portions located between circumferentially spaced apertures that provide inlet and outlet openings through which a flow of heating fluid and a flow of fluid to be heated pass into or out of the heat absorbent material carried by the rotor, said radial seal assembly comprising:

a. a rigid forward support leaf having a base portion and an extended portion extending outwardly therefrom;

b. a rigid back support leaf having a base portion disposed substantially co-lateral with and in closely spaced relationship to the base portion of the forward support leaf and an extended portion extending outwardly therefrom, the extended portion having an outward portion directed away from the extended portion of the forward support leaf to provide a gap therebetween; and c. at least one flexible sealing strip made of flow impervious resilient material having a base portion fixedly sandwiched between the portions of the forward support leaf and the back support leaf and an extended portion extending outwardly from its base portion between the extended portions of the forward support leaf and the back support leaf into the gap therebetween with a tip portion of the extended portion of the sealing strip extending outwardly beyond the extended portion of the forward support leaf, said radial assembly adapted to be mounted along its base portion to a radially extending partition of the rotor such that the tip portion of the sealing strip confronts the flow impervious portions of the end plates whereby a sealing relationship is established across the space between the end edge of the radially extending partition and the end plates.

2. A radial seal assembly as recited in claim 1 wherein the outward portion of the back support leaf is arcuate in form so as to provide a curved surface extending away from the extended portion of the forward support leaf.

3. A rotary regenerative heat exchanger comprising a rotor having a cylindrical rotor shell mounted concentrially about and joined to a central rotor post adapted for rotation about its axis by a plurality of circumferentially spaced radially extending partitions so as to divide the rotor into a plurality of sector-sahped compartments adapted to carry a mass of heat absorbent material; a cylindrical housing surrounding the rotor provided with a first end plate at one end thereof and a second end plate at the opposite end thereof with each of the end plates having flow impervious portions located between circumferentially spaced apertures that provide inlet and outlet openings through which a flow of heating fluid and a flow of fluid to be heated pass into or out of the heat absorbent material carried by the rotor with the first end plate having an inlet opening for the heating fluid and an outlet opening for the fluid to be heated and the second end plate having an outlet opening for the heating fluid and the inlet opening for the fluid to be heated; a first set of radial sealing means extending radially along and bridging the space between the end edge of each radially extending partition and the confronting face of the first end plate so as to preclude flow therebetween; and a second set of radial sealing means extending radially along and bridging the space between the end edge of each radially extending partition and the confronting face of the second end plate so as to preclude flow therebetween; each of the radial sealing means of at least one of said first set and said second set comprising: a rigid forward support leaf having a base portion substantially colateral with the radially extending partition to which it is mounted and an extended portion extending outwardly beyond the partition; a rigid back support leaf having a base portion substantially co-lateral with the base portion of the forward support leaf and with the radially extending partition to which it is mounted and an extended portion extending outwardly beyond the partition; and at least one flexible sealing strip made of a flow impervious resilient material having a base portion fixedly sandwiched between the base portions of the forward support leaf and the back support leaf with the assembled base portions fixedly mounted to the radially extending partition and having an extended portion disposed between the extended portions of the forward support leaf and the back support leaf with a tip portion extending therefrom for contacting in sealing relationship the confronting face of the first end plate, the extended portion of the back support leaf having an outward portion adapted to limit the backward movement of the flexible sealing strip so as to preclude stressing of the flexible sealing strip beyond the yield point of the resilient material from which the sealing strip is constructed.

4. A rotary regenerative heat exchanger as recited in claim 3 wherein the outward portion of the back support leaf is arcuate in form so as to provide a curved surface extending away from the extended portion of the forward support leaf.

* * * * *